US005794391A

United States Patent [19]

Howard

[11] Patent Number: 5,794,391

[45] Date of Patent: Aug. 18, 1998

[54] REINFORCED FIBERGLASS STEPS

[76] Inventor: John M. Howard, 170 E. Alton Ave., East Alton, Ill. 62024

[21] Appl. No.: 794,857

[22] Filed: Feb. 5, 1997

[51] Int. Cl.[6] ..... E04F 11/09

[52] U.S. Cl. ..... 52/182; 52/188; 52/190

[58] Field of Search ..... 52/182, 188, 190; D25/62, 63, 65

[56] References Cited

U.S. PATENT DOCUMENTS

| | | | |
|---|---|---|---|
| D. 194,399 | 1/1963 | DeMuth | D25/62 |
| D. 290,044 | 5/1987 | Daly | D25/62 |
| D. 293,475 | 12/1987 | Daly | D25/62 |
| 3,830,337 | 8/1974 | Todd | 52/182 X |
| 4,599,835 | 7/1986 | Rinke | 52/184 |
| 4,706,425 | 11/1987 | Brumbalough | 52/190 X |
| 5,644,873 | 7/1997 | Bourgault | 52/182 |

FOREIGN PATENT DOCUMENTS

| | | | |
|---|---|---|---|
| 2704588 | 11/1994 | France | 52/182 |

*Primary Examiner*—Robert Canfield

*Attorney, Agent, or Firm*—Don W. Weber

[57] ABSTRACT

A lightweight, highly portable, yet strong, fiberglass step unit is presented. The fiberglass step unit is tapered to allow removal of the unit from the mold during the two-step manufacturing process. All of the corners and edges of the fiberglass unit are rounded, thus providing strengthening radii at critical points of the construction of the unit. In addition to the strength of the fiberglass, strengthening braces are placed inside the unit and are sealed to the main portion of the unit with an additional application of fiberglass. These strengthening braces provide additional radii which synergistically add to the strength and reliability of the step. A heating coil may also be fabricated within the fiberglass step thickness itself thus providing a highly portable, lightweight, unitary step which may be electrified to prevent the accumulation of snow or ice on the step.

10 Claims, 3 Drawing Sheets

REINFORCED FIBERGLASS STEPS

BACKGROUND OF THE INVENTION

This invention relates to the field of building construction. More particularly, it discloses a new fiberglass step unit for use with housing, mobile homes, or other buildings.

In the construction trade, it is common for unitary step units to be prefabricated at one location and then delivered to the construction site. Prior to this time, these steps have normally been constructed of concrete. The concrete step has been found to be sturdy, safe, and semi-portable, although the transportation of a concrete step unit to a construction site is often cumbersome. It has not heretofore been known in the trade to have a highly portable and highly transportable step unit.

Several problems have been encountered previously in this particular field. One problem is the transportation of heavy and bulky concrete steps to the construction site. Another problem is the placement of a heavy step into the proper position with respect to the building. A further problem is encountered due to the bulk of the concrete step in the exact positioning of the step unit. The bulky units are difficult to maneuver or position. A fiberglass unit also is not subject to deterioration due to weather conditions, salt, heat or dampness.

It is an object of this invention to provide a sturdy, safe, yet lightweight and highly portable step unit for use in the construction trades. It is another object of this invention to provide a highly portable and maneuverable step unit which is easily placed in the proper location. Other and further objects of this invention will become obvious upon reading the below described Specification.

BRIEF DESCRIPTION OF THE INVENTION

A sturdy yet safe and highly portable fiberglass reinforced plastic step is presented. The step is formed in essentially two pieces, a fully formed unitary step having a number of risers and treads, an upper landing, and two sides. The unit also has a back integrally formed with the landing, sides and steps. The step unit is formed from a fiberglass mold. However, there are no sharp or flat edges on the unit as all step edges, riser-step corners and inner edges have been rounded so as to provide the maximum amount of strength. In addition to the rounded nature of all of the corners and edges, the step is also reinforced with either flat reinforcing slats or triangular reinforcing slats. These reinforcing slats create additional rounded radii which provide additional strength and safety for the fiberglass step. Since the step is made of fiberglass rather than the traditional concrete composition, the step is highly portable, easily installed, and easily positioned to exact requirements. The steps come in all sizes and with a variety of width, heights, and steps.

DETAILED DESCRIPTION OF THE PREFERRED EMBODIMENT

Figure 1:
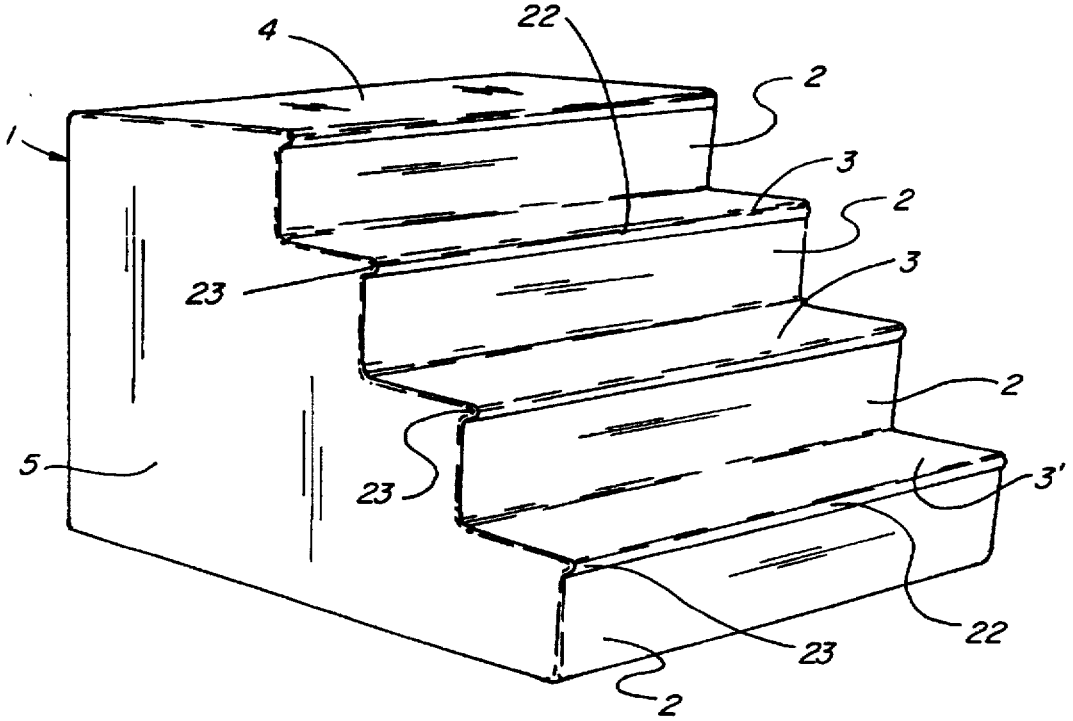
FIG. 1 is a perspective view of the unitary fiberglass step.

A unitary fiberglass reinforced plastic step (fiberglass step unit) 1 comprises a series of horizontal steps or treads 3 raised a pre-determined level by a series of corresponding essentially vertical risers 2. At the top of the step unit is a larger horizontal platform or landing 4. The step also has sides 5 and a back 8, shown on FIGS. 2 and 3.

Figure 2:
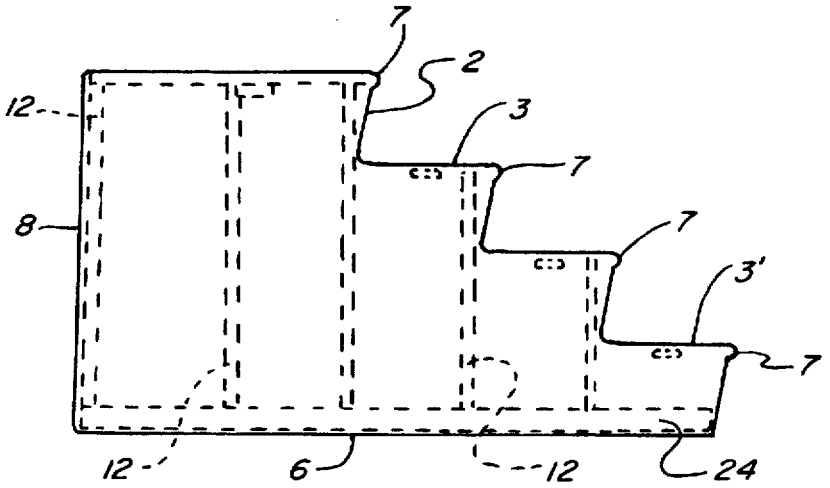
FIG. 2 is a side view of the unitary fiberglass step, showing the side braces in dotted lines.

Turning now to FIG. 2, the side view of the unitary step unit is shown. Each riser 2 meets the horizontal step tread 3 as shown. The bottom 6 of the unit is in contact with the ground.

The unit rises from the ground level in an essentially vertical direction until the first step tread 3'. The riser has a backdraft of approximately one inch to comply with safety regulations. This backdraft also makes the steps safer. The riser is normally approximately eight inches in height while the tread surface of the step is normally ten inches in width.

Figure 7:
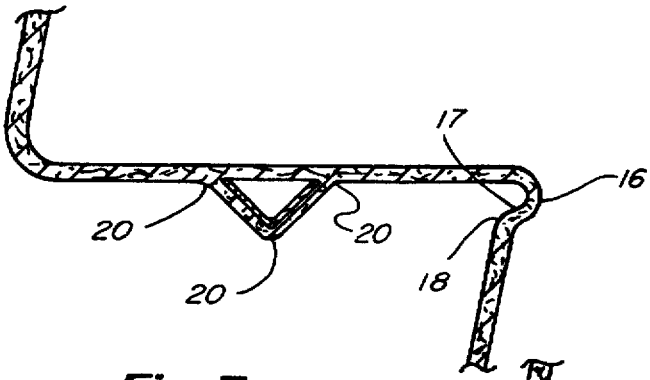
FIG. 7 is a view similar to that in FIG. 6, however, including a triangular reinforcing slat.
Figure 6:
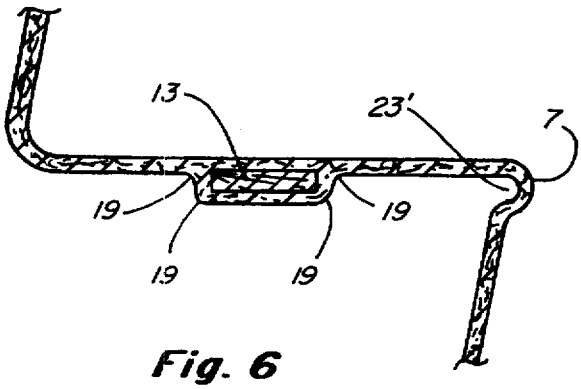
FIG. 6 is a detailed cutaway view of the step tread, and risers taken along line 6—6 of FIG. 4.

In the standard concrete step unit, the juncture edge joint 22 between the riser and the step tread would normally be square or nearly so. However, in this application, each of the normally perpendicular angles have been rounded so as to provide flanged surfaces. The rounded outside radius 7 of each step 3 is shown in FIGS. 2, 6 and 7.

Figure 3:
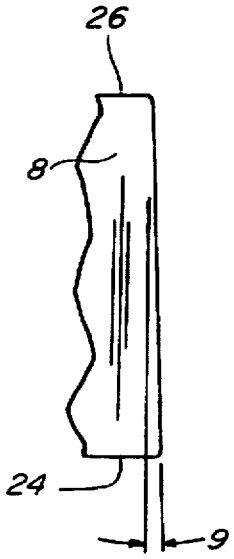
FIG. 3 is a partial cutaway view of the rear portion of the step showing the downwardly and outwardly taper.

FIG. 3 is a partial side view showing the back 8 of the unit. In the manufacturing process, the unit shown in FIGS. 1 and 2 is manufactured as one piece. However, the back of the mold is only secured to the other portion of the mold once the steps, risers, sides and landing have been coated. This two piece mold enables the workman to roll out the bubbles or other defects in the fiberglass and allows easy access to the inner surfaces. The unitary step unit which is used at the building site is, however, a single, unitary piece.

Figure 4:
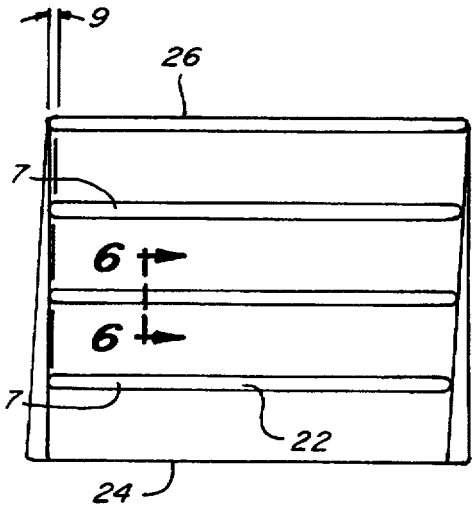
FIG. 4 is a front view of the unitary fiberglass step showing the same taper in FIG. 3.

In order to facilitate the removal of the step unit, the unit is tapered outwardly in a downwardly direction. This taper 9 is shown in FIGS. 3 and 4. Tapering the fiberglass step unit in this manner is necessary in order to remove the finished step unit from the mold. This taper 9, shown on the front view, FIG. 4, is a downwardly and outwardly taper of the finished unit. Obviously, the mold, which is the mirror image of the fiberglass unit, must be specifically constructed so as to produce this tapered shape.

Figure 5:
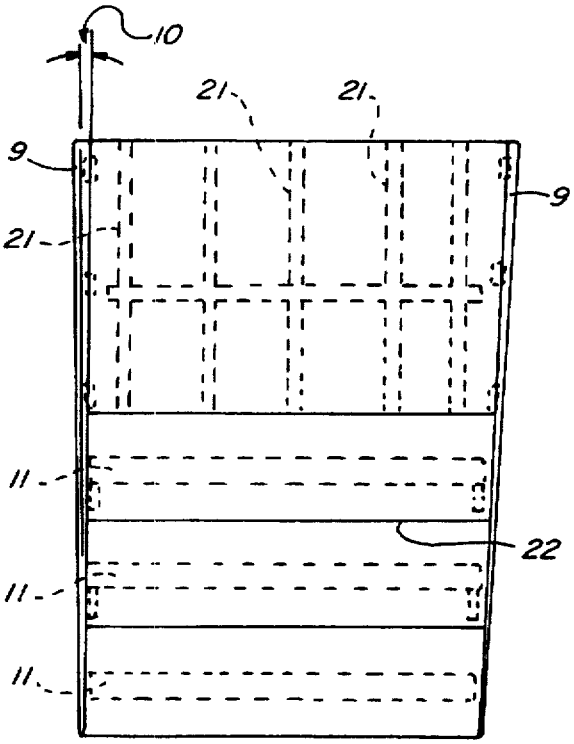
FIG. 5 is a top view of the unitary fiberglass step showing the horizontal taper of the step as well as the location of some of the reinforcing slats.

Turning now to FIG. 5, a top view of the unitary fiberglass step is shown, demonstrating the horizontal taper of the finished fiberglass step unit. This top view shows the back to front downwardly and inwardly taper 10 of the fiberglass unitary step. The result of the tapers shown in FIGS. 3, 4 and 5 are unique to the construction and manufacture of the fiberglass step unit. Tapers 9 and 10 impart a trapezoidal shape to both the back and front of the finished step (FIGS. 3 and 4) and to the top view of the finished step (FIG. 5). The longer edge of the trapezoid is at the bottom 24 of the step, shown on FIGS. 3 and 4, and at the outer edge 25 of the landing shown on FIG. 5. On the partial back view of the step (FIG. 3) and the front view of the step (FIG. 4) the shorter edge of the trapezoidal shape is shown at 26. The shorter edge of the trapezoidal shape on the top view, FIG. 5, is shown at 27. These tapers are necessary in the manufacturing of the unit in order to facilitate, or even make possible, the extraction of the outer mold from the finished unitary fiberglass step. The vertical taper 9, shown in FIGS. 3 and 4, as well as the horizontal taper 10, shown in FIG. 5, make this extraction possible. To remove the unit from the mold the back mold piece is removed from the mold.

Unique to the production of the instant fiberglass step are a number of strengthening braces 11 found on the tread surfaces 3 and the side strengthening braces 12 shown in FIG. 2. These strengthening braces 11 and 12 are essential to the proper functioning, strength and safety of the unit. Although fiberglass is an inherently strong material, these strengthening braces have been found to be necessary in order to support the loads which are normally carried by a step. Safety factors dictate that a number of braces be placed, approximately as shown. Braces run the length of each tread along the approximate center thereof and as shown in FIGS. 2 and 5. While the placement of the strengthening braces 11 and 12 are shown in the preferred embodiment illustrated in FIGS. 2 and 5, these are meant as an illustration only and not as a limitation to the placement, location, or number of braces.

A plurality of landing braces 21 are also preferably used in order to strengthen the landing 4. A 2"×2" bottom brace 24 is also used. This brace 24 must be at least ¼∴" above the bottom of the unit.

Turning now to FIGS. 6 and 7, a cross-sectional view of a tread, riser combination is shown. The strength of the entire unit is dependent upon several critical factors, including the rounded radii of the edges as well as the created rounded radii which surround the bracing material. In one embodiment, flat wood braces 13 as shown in FIG. 6 are placed along the length of the tread surface 3 in the approximate center of the width. Once these flat wooden braces have been placed during the manufacturing method, the flat brace is then coated with a second layer of fiberglass.

The flat braces 13 have a rectangular cross-section. Although the wood would not provide a great deal of reinforcement strength to the tread, the combination of the wood 13 along with the flat brace radii 19 created by the presence of the flat wood 13 create a much stronger unitary step unit. The strength lies in the creation of these radii 19 as well as the initial support provided by the wood. It has been found after experimentation that the wood covered with fiberglass has a synergistic effect and a very strong and reliable unitary step unit is thus created. Since the wood is entirely coated with fiberglass, it is protected from deterioration due to dampness, salt, or other contaminants.

Another method of manufacturing this step involves the use of stiff cardboard having a triangular cross-section. This cardboard brace 14, when placed as shown in FIG. 7, creates a number of additional triangular strengthening radii 20 which greatly add, in a synergistic matter, to the entire strength of the unit. The flat section of said triangular brace is placed parallel to the flat portion of the step, landing, back or sides of the unit. Using either the flat brace 13 or the triangular braces 14 creates a very strong step which is both safe and capable of holding heavy loads.

Another unique feature of the manufacture of this fiberglass step lies in the rounded radii 16, 17 and 18 shown in FIG. 7. Instead of the riser and tread forming an essentially perpendicular edge 22 along their length, all of these edges 22 in this particular fiberglass step are rounded. An outside edge radius 16 replaces the normally flat edge found in ordinary steps. Additionally, the inside corresponding edge 17 has a rounded radius which in turn connects to a lower inside edge radius 18. The combination of these edge radii 16, 17 and 18 further add to the strength and safety of the unitary step unit.

In the manufacture of this particular product, all of the inner edges are beveled, particularly when one radii would meet another radii, for example at the juncture edge joint 22 of any of the riser-tread combinations. A tri-corner edge 23 is also formed at the confluence of radii between the edge of the riser, tread and sides. The confluence of these three edges, shown on FIG. 1, would normally have a radius for each edge meeting in the corners 23 as shown. However, on the corresponding inside of this unit at point 23' (see FIGS. 6 and 8), the three edges are beveled and rounded thus creating a much stronger and superior step in the process. The beveling of these bisecting edges, as well as the use of strengthening braces and edge radiuses is unique to the particular manufacture and construction of this step unit.

The fiberglass step unit is created from an original wood step or master unit which is sculptured so as to create the approximate areas and shape of the unitary step. The next procedure is to spray a black tooling gel onto the sculptured wood step and to sand that wood unit to a mirror-like finish.

Figure 8:
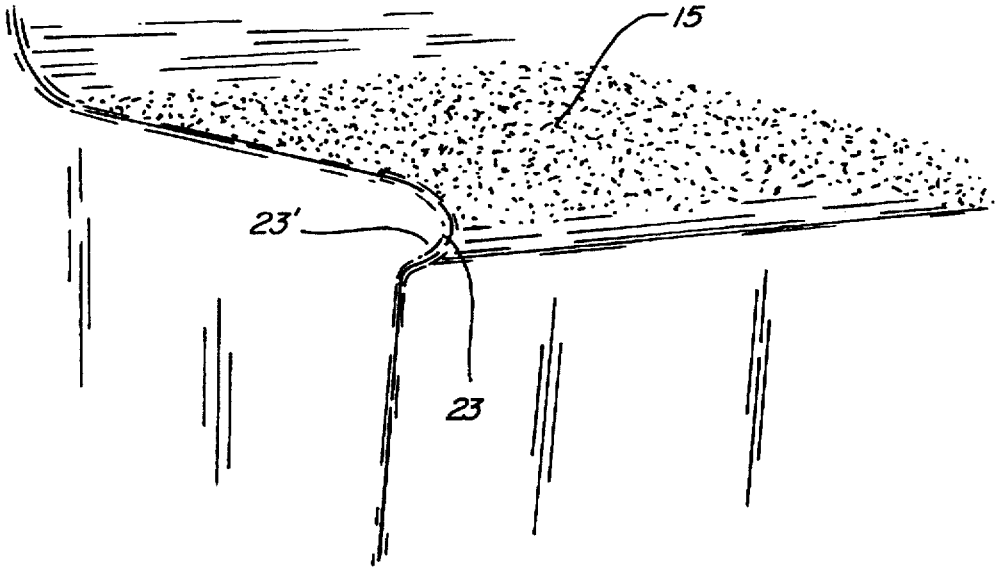
FIG. 8 is a detailed corner view of one of the steps, showing the non-skid composite surface.
Figure 9:
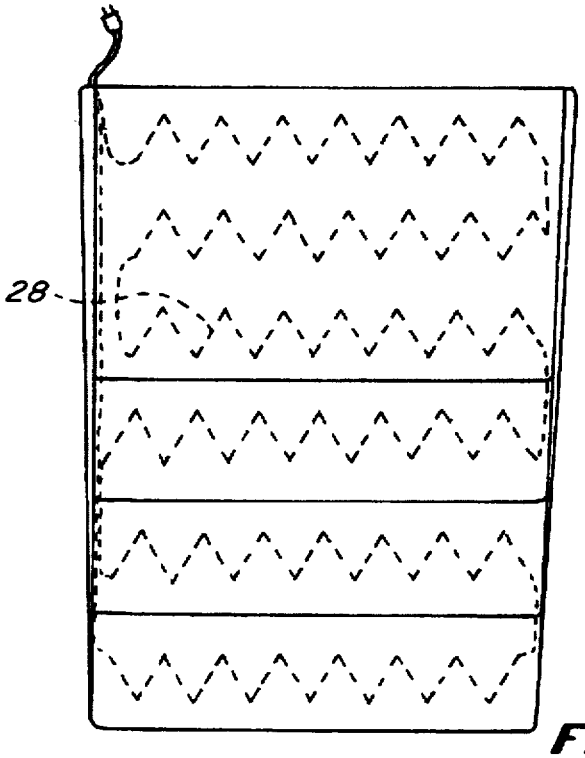
FIG. 9 is a top view of the step showing the electrical tape in phantom.

After the sculptured master unit is prepared, a non-skid texture, normally comprising 35% black gel coat and 65% fumed silica, is applied to the tread and landing surfaces. The net result of applying this coat to the tread and landing surfaces is to create a rough, rather than smooth, walking surface. This surface 15 is desirable for safety reasons in that it creates a non-skid texture. The surface is best shown in FIG. 8.

The next step in the preparation of the unitary fiberglass step is to clean all surfaces of the master with a rag and a stripper cleaner to remove all dust, paint, or other contamination. Eight coats of wax are then applied to the master, usually using a paste wax. This wax is necessary in order to keep the fiberglass step unit from bonding to the mold once the step has been fabricated. A tooling gel coat paint is then provided. The paint has two functions, one of which is to shield the mold from the heat which is created during the manufacturing process. Another purpose of the tooling gel coat is to color the mold a particular color, for example green, so that a person applying fiberglass to the mold is able to determine when all of the mold has in fact been covered with the fiberglass material. The tooling gel coat is approximately 35 millimeters in thickness.

Next, a 1½ ounce fiberglass mat is applied to the master such that the mold is formed. The thickness of the mold will be anywhere from ⅜" to ½". It has been found in practice that this is the preferred thickness since the mold must be manufactured so that it will not warp or otherwise distort from the excessive amount of heat build-up created during the application of the fiberglass to the inside of the mold.

Reinforcing the mold is a wood and pipe frame which also helps keep the mold in its designed shape.

Once the mold has been prepared with approximately eight coats of wax, it is ready for the application of the fiberglass reinforced plastic to create the unitary step. First, 18 to 20 millimeters of a white gel coat is sprayed onto the inside of the mold to provide the outside color of the finished unit. Then 150 millimeters of fiberglass reinforced plastic is sprayed onto the inside of the mold to create the essential step surface. This also creates heat, as described above. During the application process, workmen routinely roll out the bubbles by hand, thus eliminating any air pockets and creating a smooth fiberglass surface. This procedure is made possible because of the two-step mold described above.

Once the essential unitary step body 1 has been thus created, the reinforcing braces are placed on the inside of the fiberglass step. These braces may be the flat wood braces 13, the triangular cardboard braces 14, or any geometric configuration and any composition. The purpose of the braces is to create strengthening radii 19 and 20 as previously described. Once the strengthening braces have been placed on the inside of the unit, approximately 75 millimeters of fiber glass reinforced plastic is then sprayed over the braces. This creates the strengthening radii 19 and 20. It is necessary to entirely seal the strengthening braces such that water, ice, or other deteriorating elements may not be introduced to the wood, cardboard, or other bracing material. In order to insure this, both the flat braces 19, cardboard braces 14 and strengthening side braces 12 must be fully encased in the fiberglass. It is of particular note that the lower strengthening brace 12 must be located above the bottom 6 of the unit, as shown on FIG. 2, such that the strengthening brace 24 may be fully encased and completely surrounded by the fiberglass.

Once the unit has been formed and the fiberglass has been applied around the strengthening braces, the unit is left to cure. After curing, the back of the mold is removed and the unit is then popped away from the mold. Removal is made possible by the above mentioned vertical and horizontal tapers.

It is critical that the wood braces be placed in the unit for strengthening purposes. The wood thickness is also of importance, and it has been found that flat wood slats between ½" and ⅝ in thickness have the desired dimensions. The slats are approximately the same length as the step tread.

The fiberglass steps can in many varying sizes with the most common total height of a unit being from 16" to 32". The average step is approximately 38" in width with a top landing of approximately 24". The steps may come in two, three, four or any other variation of steps and risers depending upon the application.

Metal handrails may also be attached to the side of the step for further safety.

Several unique features are involved in the manufacture of this particular fiberglass step unit. First it is to be noted that there are no square corners anywhere on the unit, thus contributing to the strength of the unitary step. The tapers are also necessary in order to remove this particular geometric configuration from the mold. The two-piece nature of the mold is also novel, and for access to the inside and corners of the unit and for a non-uniform unit such as a step to be manufactured.

The use of the strengthening braces has been found to approximate a standard fiberglass unit that is twice as thick as the unit disclosed herein.

One other variation of this fiberglass step involves the use of electrical heating tape 28 integrally molded into the treads and landing surfaces of the step. Since the step is molded of fiberglass, this heating unit is capable of keeping ice and snow off of the step, because fiberglass is an excellent medium for transferring and holding heat.

The creation of the unitary fiberglass step unit as described above will provide a strong yet safe and highly portable and maneuverable unit in the building and construction trades. The ease of transportation, low cost of production, ease of installation and other factors all combine to create the ideal portable step unit.

Having fully disclosed my invention, I claim:

1. An integral step unit for use in the construction trade, comprising:

(a) a plurality of essentially vertical risers and corresponding perpendicular tread surfaces forming a plurality of steps, wherein the juncture edge joint of each of said risers and treads comprises a rounded outside edge surface and a rounded inside edge radius, each of said vertical risers further comprising a lower inside radius;

(b) an upper horizontal landing perpendicular and attached to the uppermost riser and to said sides;

(c) left and right sides corresponding and integrally attached to said landing, risers, and treads;

(d) a back of said unit integrally attached to said sides and landing surface;

wherein said unit is made of fiberglass reinforced plastic and wherein said unit tapers downwardly and outwardly from said landing surface and tapers inwardly from the back to the front of said unit.

2. An integral step unit for use in the construction trade as in claim 1, further comprising a plurality of braces positioned on the inside of said unit to strengthen said unit, including at least one brace bonded to each tread, running the length of said tread and located in the approximate center thereof, and a plurality of elongated braces bonded to the back, each side and the landing of said unit, whereby the strength of said unit is increased.

3. An integral step unit for use in the construction trade as in claim 2, wherein said braces are bonded to the inside of said unit by coating said braces and the area adjacent thereto with fiberglass reinforced plastic.

4. An integral step unit for use in the construction trade as in claim 3, wherein said braces are flat, elongated, wooden slats having a rectangular cross-section.

5. An integral step unit for use in the construction trade as in claim 4, wherein bonding said flat braces to the inside of said step unit creates flat brace strengthening radii along the length of each side of said brace.

6. An integral step unit for use in the construction trade as in claim 3, wherein said braces are elongated, cardboard braces having a triangular cross-section.

7. An integral step unit for use in the construction trade as in claim 6, wherein bonding said triangular braces to the inside of said step unit creates triangular brace radii along the length of each side of said brace and a strengthening radius at the apex of said triangular brace.

8. An integral step unit for use in the construction trade as in claim 1, further comprising a tri-corner strengthening radius at each intersection of said riser, tread and side, wherein said radius is thickened and rounded for strength.

9. An integral step unit for use in the construction trade as in claim 1, further comprising a heating tape embedded in each tread and said landing whereby the accumulation of snow and ice on the tread and landing surface is retarded.

10. An integral step unit for use in the construction trade, as in claim 1, further comprising a plurality of braces positioned on the inside of said unit to strengthen said unit, including two braces underneath the top of the landing running the length of said landing and one brace near the bottom of the back of said unit, and running the length of the back of said unit, whereby the strength of said unit is increased.

* * * * *